US005803451A

United States Patent [19]

Kelly et al.

[11] Patent Number: 5,803,451

[45] Date of Patent: Sep. 8, 1998

[54] ARCADE GAME HAVING MULTIPLE SCORE INDICATORS

[75] Inventors: Matthew F. Kelly, San Ramon; Bryan M. Kelly, Alamo, both of Calif.

[73] Assignee: RLT Acquisition, Inc., Pleasanton, Calif.

[21] Appl. No.: 718,631

[22] Filed: Sep. 17, 1996

Related U.S. Application Data

[63] Continuation-in-part of Ser. No. 428,524, Apr. 21, 1995, Pat. No. 5,700,007, which is a continuation of Ser. No. 176,862, Jan. 3, 1994, Pat. No. 5,409,225, which is a continuation of Ser. No. 956,057, Oct. 2, 1992, Pat. No. 5,292,127.

[51] Int. Cl.[6] ..... A63F 7/00

[52] U.S. Cl. ..... 273/118 R; 273/138.1; 273/123 R

[58] Field of Search ..... 273/118 R, 118 A, 273/118 D, 119 R, 119 A, 123 R, 123 A, 138.01

[56] References Cited

U.S. PATENT DOCUMENTS

| | | | |
|---|---|---|---|
| D. 272,920 | 3/1984 | Wichinsky et al. . | |
| D. 278,069 | 3/1985 | Wichinsky et al. . | |
| D. 332,976 | 2/1993 | Gutknecht et al. . | |
| 473,265 | 4/1892 | Reisky . | |
| 810,299 | 1/1906 | Pettee . | |
| 941,194 | 11/1909 | Hamilton . | |
| 1,543,318 | 6/1925 | Cardoza . | |
| 1,563,983 | 12/1925 | Higuchi . | |
| 1,652,071 | 12/1927 | Tsujino . | |
| 1,879,511 | 9/1932 | Rodgers . | |
| 2,141,580 | 12/1938 | White . | |
| 2,211,617 | 8/1940 | Faber | 273/123 A |
| 2,660,434 | 11/1953 | Durant . | |
| 2,736,559 | 2/1956 | Turner . | |
| 2,926,915 | 3/1960 | Johns . | |
| 3,268,227 | 8/1966 | Thatcher . | |
| 3,275,322 | 9/1966 | Burnside | 273/119 A |
| 3,275,324 | 9/1966 | Burnside . | |
| 3,275,325 | 9/1966 | MacKenzie . | |
| 3,384,375 | 5/1968 | Zifferblatt . | |
| 3,399,896 | 9/1968 | Burnside . | |
| 3,429,574 | 2/1969 | Willliams . | |
| 3,537,707 | 11/1970 | Goldberg . | |
| 3,584,877 | 6/1971 | Florian . | |
| 3,807,736 | 4/1974 | Goldfarb . | |
| 3,825,265 | 7/1974 | Pitkanen et al. . | |
| 3,843,129 | 10/1974 | Dietrich . | |
| 3,851,879 | 12/1974 | Hicks . | |
| 3,947,030 | 3/1976 | Goldfarb . | |
| 4,002,339 | 1/1977 | Reiner et al. . | |
| 4,030,555 | 6/1977 | Boyce et al. . | |
| 4,120,501 | 10/1978 | Atherton . | |
| 4,157,828 | 6/1979 | Cosmopulos . | |
| 4,177,996 | 12/1979 | Chang . | |
| 4,212,465 | 7/1980 | Arad . | |
| 4,216,961 | 8/1980 | McQuillan . | |

(List continued on next page.)

OTHER PUBLICATIONS

"Sidewinder," Bob's Space Rider, Inc. 1991, 1993, pp. D380–D381.

"Legalized Games of Chance Control Commission," Statues & Regulations Governing Conduct of Amusement Games, Feb. 1993, pp. D362–D376.

"Gambling Devices Act of 1962," Title 15, U.S. Code § 1171–1177, Section § 1171.

*Primary Examiner*—Raleigh W. Chiu
*Attorney, Agent, or Firm*—Hickman & Martine, LLP

[57] ABSTRACT

A skill-based game including multiple score indicators is disclosed. The skill-based game preferably involves rolling a playing piece down a playing surface towards targets, and allowing the user to use the targets to manipulate multiple score indicators, so as to use one's skill to obtain a winning combination. In a preferred embodiment, the playing piece is a ball and the multiple score indicators are mechanically rotated dice. Progressive scoring can also be provided. The invention attracts players and retains their interest so that they tend to repeatedly use the game.

30 Claims, 9 Drawing Sheets

U.S. PATENT DOCUMENTS 4,227,690 10/1980 Pitkanen .
4,260,153 4/1981 Nishimiya .
4,348,028 9/1982 Barlow .
4,354,680 10/1982 Kmiec .
4,363,485 12/1982 Edwall .
4,397,463 8/1983 Moscovich .
4,437,664 3/1984 Wiczer et al. .
4,496,160 1/1985 Wichinsky et al. .
4,569,522 2/1986 Davies .
4,602,789 7/1986 Chung .
4,662,846 5/1987 Quercetti .
4,701,056 10/1987 Barlow .
4,732,391 3/1988 Karr .
4,743,024 5/1988 Helm .
4,772,024 9/1988 Werner .
4,837,728 6/1989 Barrie .
4,892,311 1/1990 Zaitsu .
4,930,779 6/1990 Maddox .
4,948,133 8/1990 Helm .
4,957,296 9/1990 Turnidge .
5,002,279 3/1991 Kaminkow .
5,014,988 5/1991 Mirando .
5,014,991 5/1991 Mirando .
5,016,880 5/1991 Berge .
5,024,441 6/1991 Rousseau .
5,042,813 8/1991 Huang .
5,066,014 11/1991 Dobson .
5,067,712 11/1991 Georgilas .
5,090,699 2/1992 Friedman .
5,096,192 3/1992 Stanford .
5,100,139 3/1992 Di Bella .
5,104,129 4/1992 Hämäläinen et al. .
5,116,055 5/1992 Tracy .
5,121,919 6/1992 Martti .
5,131,655 7/1992 Ugawa .
5,137,278 8/1992 Schilling .
5,149,093 9/1992 Schilling .
5,181,722 1/1993 Krutsch .
5,184,821 2/1993 Korenek .
5,280,909 1/1994 Tracy .
5,292,127 3/1994 Kelly et al. .
5,342,049 8/1994 Wichinsky et al. .
5,344,144 9/1994 Canon .
5,364,098 11/1994 Kaminkow .
5,374,061 12/1994 Albrecht .
5,385,347 1/1995 Halliburton .
5,409,225 4/1995 Kelly et al. .

ARCADE GAME HAVING MULTIPLE SCORE INDICATORS

CROSS REFERENCE TO RELATED APPLICATIONS

This application is a continuation-in-part of (i) U.S. Provisional Application Ser. No. 60/004,053 filed Sep. 20, 1995, and (ii) U.S. application Ser. No. 08/428,524 filed Apr. 21, 1995, (now U.S. Pat. No. 5,700,007 ) which is a continuation of Ser. No. 08/176,862 filed Jan. 3, 1994 (now U.S. Pat. No. 5,409,225) which is in turn a continuation of Ser. No. 07/956,057 filed Oct. 2, 1992 (now U.S. Pat. No. 5,292,127), all of which are assigned to the assignee of the present application.

BACKGROUND OF THE INVENTION

1. Field of the Invention

This invention relates to games normally played in an arcade environment, and more particularly, to such games played by directing a playing piece towards a target.

2. Background of the Related Art

Roll-down games have been played for many years in arcade environments. These games usually include a ramp and one or more targets at the end of the ramp. A player rolls a ball down the ramp towards a desired target, and a game score is displayed on a scoring display based upon the player's success. As examples, U.S. Pat. No. 810,299 describes a game in which a ball is rolled down a plane towards an upright target pin, and U.S. Pat. No. 2,926,915 describes a skee-ball game in which a ball is rolled towards a scoring drum and in which tickets are dispensed to the player by an electrically operated automatic ticket dispenser. Similarly, an example of a ball-toss game in which a ball is tossed into holes marked in various time intervals is described in U.S. Pat. No. 2,141,580. The object of this exemplary ball-toss game is to make the dial stop at a chosen character or numeral on the dial face.

Roll-down and ball-toss games of the prior art, while enjoyable, are rather simple games and, as such, often lead to rapid player boredom. This is undesirable in an arcade environment where revenues are directly related to the continuous, repeated use of the games.

Other known games provide some more sophistication, but lack the ability to enable a player to manipulate multiple indicators using skill. Examples of such games are as follows.

U.S. Pat. No. 5,342,049 discloses a gaming machine which combines the features of a slot machine with a pinball machine. The machine allows a player a second chance to win if he is able to use his skill on the pinball-type playing surface to obtain a respin of one or more of the reel slots of the slot machine.

U.S. Pat. No. 5,014,991 discloses a poker amusement game which uses rubber balls and 25 openings within a playing field. The players are given the chance of discarding certain balls and having them ejected to randomly bounce within the playing area so as to reselect one of the available 25 openings.

U.S. Pat. No. 5,385,347 discloses a coin operated amusement device which operates by rolling coins down an inclined track towards a rotating wheel which has different pay-off positions distributed around the wheel.

U.S. Pat. No. 4,002,339 discloses a poker pool game in which balls are shot into particular pockets to obtain a particular poker hand. A scoreboard illuminates the card associated with the pocket in which the ball has been placed.

U.S. Pat. No. 3,384,375 discloses a game in which balls or other projectiles are rolled or slid in lanes towards several holes at the end of the lanes. The player gains points by various combinations of the openings depending on which a plurality of the coin slots the player has deposited a coin.

U.S. Pat. No. 3,399,896 discloses a game in which balls are used to randomly select numbers which are then displayed. The player can selectively transform a set of indicia in a matrix and thereby obtain a score which is partially dependent on his skill in selecting a proper matrix.

Thus, although the sophistication of skill-based games has improved over the years, there remains a need for skill-based games in which players are able to manipulate multiple score indicators.

SUMMARY OF INVENTION

Broadly speaking, the invention concerns an apparatus and method for a skill-based game including multiple score indicators. The skill-based game preferably involves rolling a playing piece down a playing surface towards targets, and allowing the user to use the targets to manipulate multiple score indicators, so as to use one's skill to obtain a winning combination. In a preferred embodiment, the playing piece is a ball and the multiple score indicators are mechanically rotated dice. Progressive scoring can also be provided. The invention can be implemented in numerous ways, including as a method, an apparatus, or a system.

A first implementation of the invention pertains to a skill game. The skill game includes at least one playing piece, and a game cabinet having a players end and a target end. The game cabinet includes at least: a playing surface between the players end and the target end of said game cabinet, a player causes the playing piece to traverse said playing surface towards the target end; a plurality of targets in the playing surface or at the target end for receiving the playing piece, each of the targets indicating a different scoring action; and a plurality of score indicators, each of said score indicators being individually controlled in accordance with the particular one of the targets that receives the playing piece, wherein the player's score is determined by a combination of said plurality of score indicators. Preferably, each of said score indicators is a die which is rotatable, the playing piece is a ball, and the playing surface is a downwardly sloping planar surface. The skill game may also include a progressive bonus apparatus which accumulates a progressive bonus based on contributions from the plurality of game units.

A second implementation of the invention pertains to an apparatus associated with a game of skill. The apparatus includes: multiple score indicators; means for rolling a playing piece down a playing surface towards targets, and means for allowing the user to use the targets to manipulate said multiple score indicators so as to use one's skill to obtain a winning combination of the scores indicated by said multiple score indicators.

A third implementation of the invention pertains to a method associated with a game of skill. The game uses a cabinet having a players end and a target end and a playing surface therebetween, and multiple score indicators. The target end or the playing surface includes a plurality of targets for receiving the playing piece. The method includes the following operations: causing a playing piece to traverse the playing surface from the players end towards the target end; receiving the playing piece at one of the targets; causing one or more of the multiple score indicators to change based on the one of the targets that has received the playing piece;

and determining a score by a combination of the multiple of score indicators. Preferably, the one or more score indicators change depending upon the one of the targets that has received the playing piece.

A fourth implementation of the invention pertains to a method associated with a game of skill using multiple score indicators. The method includes the following operations: randomizing all the score indicators; allowing a player to lock any or all of the score indicators; designate one of the unlocked score indicators to be manipulated; allowing the player to use a skilled action to select one of a plurality of targets; manipulating the designated score indicator in accordance with the selected target; repeating the designating and the allowing operations as long as there are additional score indicators to be manipulated; and determining the player's score by a combination of the score indicators.

By enabling the player to manipulate multiple score indicators, the invention attracts players and retains their interest so that they tend to repeatedly use the game. As a result, both player involvement with the game and revenue produced by the game increase.

These and other advantages of the present invention will become apparent to those skilled in the art after reading the following descriptions and studying the various figures of the drawings.

DETAILED DESCRIPTION OF THE INVENTION

The invention concerns an apparatus and method for a skill-based game including multiple score indicators. The skill-based game preferably involves rolling a playing piece down a playing surface towards targets, and allowing the user to use the targets to manipulate multiple score indicators, so as to use one's skill to obtain a winning combination. In a preferred embodiment, the playing piece is a ball and the multiple score indicators are mechanically rotated dice. Progressive scoring can also be provided.

Figure 1:
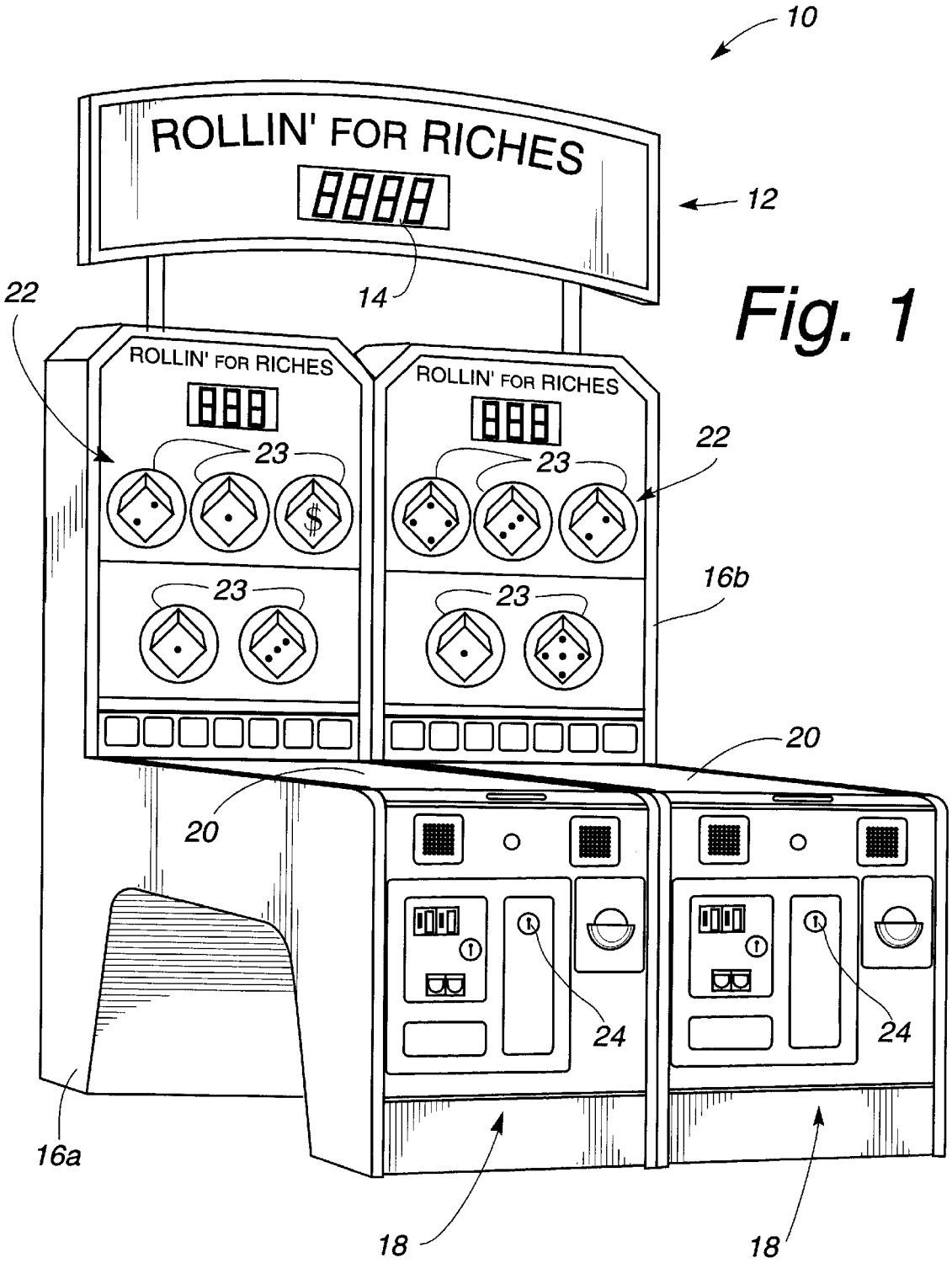
FIG. 1 is a perspective view of two individual game units connected to a progressive bonus display according to an embodiment of the invention.

In FIG. 1, a multi-station game apparatus 10 in accordance with an embodiment of the invention includes a progressive bonus apparatus 12 with progressive bonus display 14 coupled to a first individual game unit 16*a* and a second individual game unit 16*b*. Additional individual game units 16 may be coupled to the multi-station game apparatus 10 as desired.

Each individual game unit 16 has the ability to be played on its own, independent of the other game units 16 coupled to progressive bonus apparatus 12. Each individual game unit 16 includes a front panel 18 and a display area 22. A player of one of the game units 16 operates or interacts with the game unit 16 to accomplish certain goals for the game. The goals are obtained by skillful manipulation of the multiple score indicators 23. The resulting combinations of the multiple score indicators 23 determine the score the player receives for the game. To obtain these goals (i.e., higher scores) requires the use of the player's skill. For example, the goals could include skillfully guiding a playing piece (e.g., a ball) into a target aperture using hand-eye coordination, or skillfully aiming a playing piece towards a target using electrical controls.

An individual game unit 16 further has the ability to dispense a non-monetary award to a player. Such an award might be tickets redeemable for prizes. The award also could be baseball cards or other similar non-monetary prizes. In the preferred embodiment, each individual game unit 16 is capable of dispensing one or more tickets to the player from the front panel 18 through an award dispensing slot 24. The number of tickets dispensed is based on the player's score (that is, the combination of the multiple score indicators 23). Ticket dispensing mechanisms are well-known in the prior art.

Figure 2:
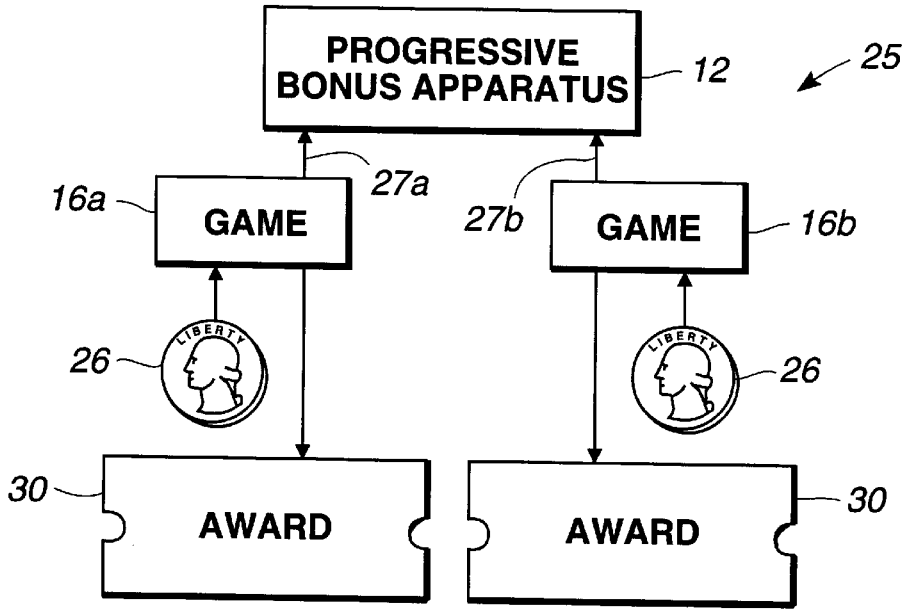
FIG. 2 is a flow diagram of the progressive enhanced award process.

The process that the multi-station game apparatus 10 uses to receive money and dispense non-monetary awards is illustrated in the block diagram 25 of FIG. 2. A player inserts monetary input 26 into an individual game unit 16*a* or 16*b*. Typically, this monetary input 26 is one or more coins, or it may be tokens that are standard in an arcade environment. Each game unit 16*a* and 16*b* is connected to the progressive bonus apparatus 12 by a data bus 27*a* and 27*b*, respectively.

The progressive bonus apparatus 12 has an output on a progressive bonus display 14 (see FIG. 1) which begins at a predetermined starting value. For example, the progressive bonus might be set at a starting score of zero. Alternatively, so that a bonus award might be immediately available to players, the starting score could be set at a higher value.

Figure 3:
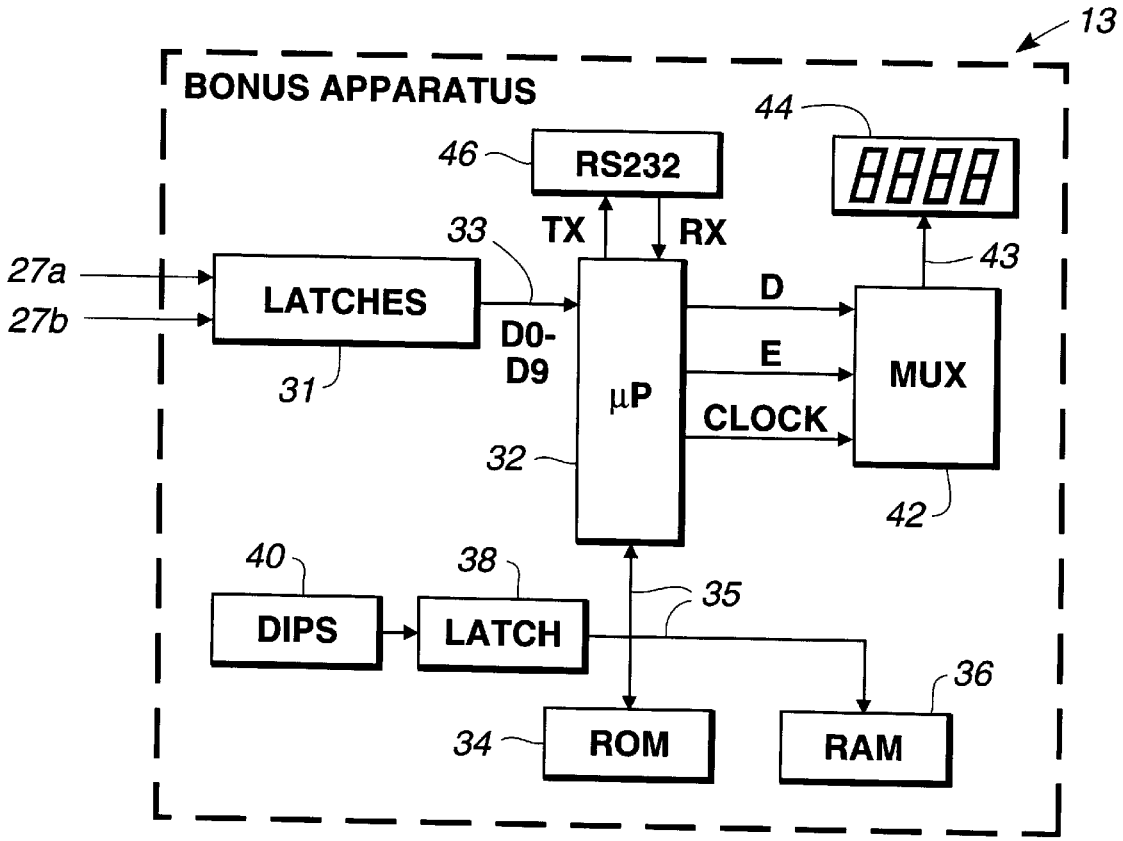
FIG. 3 is a block diagram of a control system for a progressive bonus apparatus.

The progressive bonus displayed by the progressive bonus apparatus 12 is accumulated from contributions by the individual game units 16 over the data buses 27*a* and 27*b* (FIG. 3). The contributions can be determined in a variety of ways. In the preferred embodiment, each game unit 16 sends a signal to the progressive bonus apparatus 12 whenever a player deposits a coin or coins into the game unit 16. When the progressive bonus apparatus 12 receives this signal, it increments the progressive bonus by one, one-half, or another predetermined value. Thus, each game unit 16 that is played will increment the progressive bonus by this value. Other methods might be used where the game unit 16 sends its increment signal when a player reached a predetermined score. Also, the progressive bonus apparatus 12 could be set to multiply the progressive bonus by a selected quantity whenever a game unit 16 sends an increment signal.

Each individual game unit 16 has one or more predetermined tasks for the player to accomplish in order for the player to receive a bonus award 30 based on the progressive bonus displayed by the progressive bonus apparatus 12. All game units 16 that are attached to a single progressive bonus apparatus 12 should require the same predetermined task, so that each player competing for the progressive bonus has a task of the same duration and level of difficulty. This predetermined task has several possible variations. One variation might be that the player has to achieve a specific game score on his individual game unit 16 in order to win the progressive bonus. A different variation might be that the player must finish two or more games in a row by accomplishing a specific game result, such as obtaining a Royal Straight via the combination of the multiple score indicators 23.

The first player to accomplish the predetermined task is entitled to the non-monetary bonus award 30 based upon the progressive bonus displayed on the progressive bonus apparatus 12. In the preferred embodiment, this bonus award 30 is manually given to the winning player by the owner or operator of the multi-station game apparatus 10. The bonus award 30 can be a number of normal game unit 16 awards: tickets, cards, or whatever the non-monetary award might be. Such a bonus award 30 might also be dispensed to a player as follows: the progressive bonus apparatus 12 sends the progressive bonus data over a data bus to the winning game unit 16. The winning game unit 16 then dispenses the bonus award 30 to the player by that game unit's 16 normal award-dispensing means 24. In any case, once the player has won the bonus award 30, his individual game unit 16 is reset and the progressive bonus apparatus 12 is reset. Each of the game units coupled to the progressive bonus apparatus may also be themselves continually updated by the progressive bonus apparatus 12 to show the progressive bonus that can be won by the players.

FIG. 3 is a block diagram of a control system 13 for the progressive bonus apparatus 12. The control system 13 includes a microprocessor 32, data bus 33, read-only memory (ROM) 34, random-access memory (RAM) 36, a latch 38, DIP switches 40, a multiplexer 42, an LED display 44, and an RS-232 port 46.

The microprocessor 32 may be an Intel 8031 8-bit microprocessor, which has the range of features adequate for the task, including eight data lines and sixteen address lines. The microprocessor 32 receives data inputs D0–D9 inputs on data bus 33 from individual game units 16 that are connected to the progressive bonus apparatus 12; one data line is required per game unit, so a maximum of ten individual games may be connected to the progressive bonus apparatus in this embodiment. Data latches 31 are used to couple the data buses 27*a* and 27*b* from each game unit 16 to the data bus 33. Alternatively, the progressive bonus apparatus 12 can communicate with the game units 16 using a network scheme (e.g., daisy chain) in which one or more wires commonly connect the game units 16 to the bonus apparatus 12. Wireless network schemes (e.g., infrared, RF), which would be particularly useful when the game units 16 are separated from the progressive bonus apparatus 12 by some distance, could also be used.

The microprocessor 32 is coupled to ROM 34 by an address/control/data bus 35. The ROM 34 is preferably an erasable programmable read-only memory (EPROM) that contains the start-up instructions and operating system for the progressive bonus apparatus 12. The microprocessor 32 is also connected to RAM 36 by the bus 35 to permit the use of RAM as scratch-pad memory.

The microprocessor 32 is also coupled to DIP switches 40 by a latch 38 and bus 35. The DIP switches 40 provide selectable functions that the owner or operator of the multi-unit game apparatus 10 may change to his or her liking. These selectable functions include setting the base payout score that the progressive bonus apparatus 12 will display in its starting state, and the increment value that the progressive bonus apparatus 12 will use to increase the progressive bonus. Other selectable functions could also be set by the DIP switches 40 depending on how many selectable game options and features are desired.

The microprocessor 32 is also coupled to a multiplexer 42. The multiplexer 42 receives a clock signal, an enable signal (E), and a serial LED data signal (D) from the microprocessor 32. The multiplexer 42 then outputs control signals to the segments of the LED display 44 on a bus 43. The LED display 44 implements the progressive bonus display 14 shown in FIG. 1.

The progressive bonus apparatus 12 can also optionally send and receive message signals through a standard RS-232 interface 46. The RS-232 interface allows the control system 13 to be coupled to a computer system or other data processing system to allow the control and analysis of the control system 13.

The control system 13 for the progressive bonus apparatus 12 operates as follows. The microprocessor 32 first reads the low memory from ROM 34 over bus 35 and then sequences through the software instructions stored in ROM 34. The software from the ROM 34 instructs the microprocessor 32 to read the DIP switches 40, read in the game unit signals on buses 27*a* and 27*b* from the latches 31, and display or update the score LED display 44 with the information from the game unit signals. If a game unit signal on buses 27*a* or 27*b* indicates a game is over, the microprocessor 32 modifies the progressive bonus by the determined amount. When a game unit signal on buses 27*a* or 27*b* indicates that a game unit 16 has won the progressive bonus award, the microprocessor 32 sends signals to flash the score display and activate lights and sound speakers (not shown) indicating the bonus has been won. The owner or operator of the game units 16 may then present the bonus award to the player who won it. Alternatively, the microprocessor 32 in progressive bonus apparatus 12 sends the progressive bonus total to the winning individual game unit 16 over a data bus, and the individual game unit 16 can then dispense the bonus award to the player.

Additional details on progressive bonus operation may be found in commonly-owned U.S. Pat. Nos. 5,409,225 and 5,292,127 that describe a game in which a playing piece is directed towards targets and a wheel is spun according to the target that the playing piece hit. The player is also dispensed a non-monetary award based on the player's score and the award may include a progressive bonus. U.S. Pat. Nos. 5,409,225 and 5,292,127 are hereby incorporated by reference herein.

Figure 4:
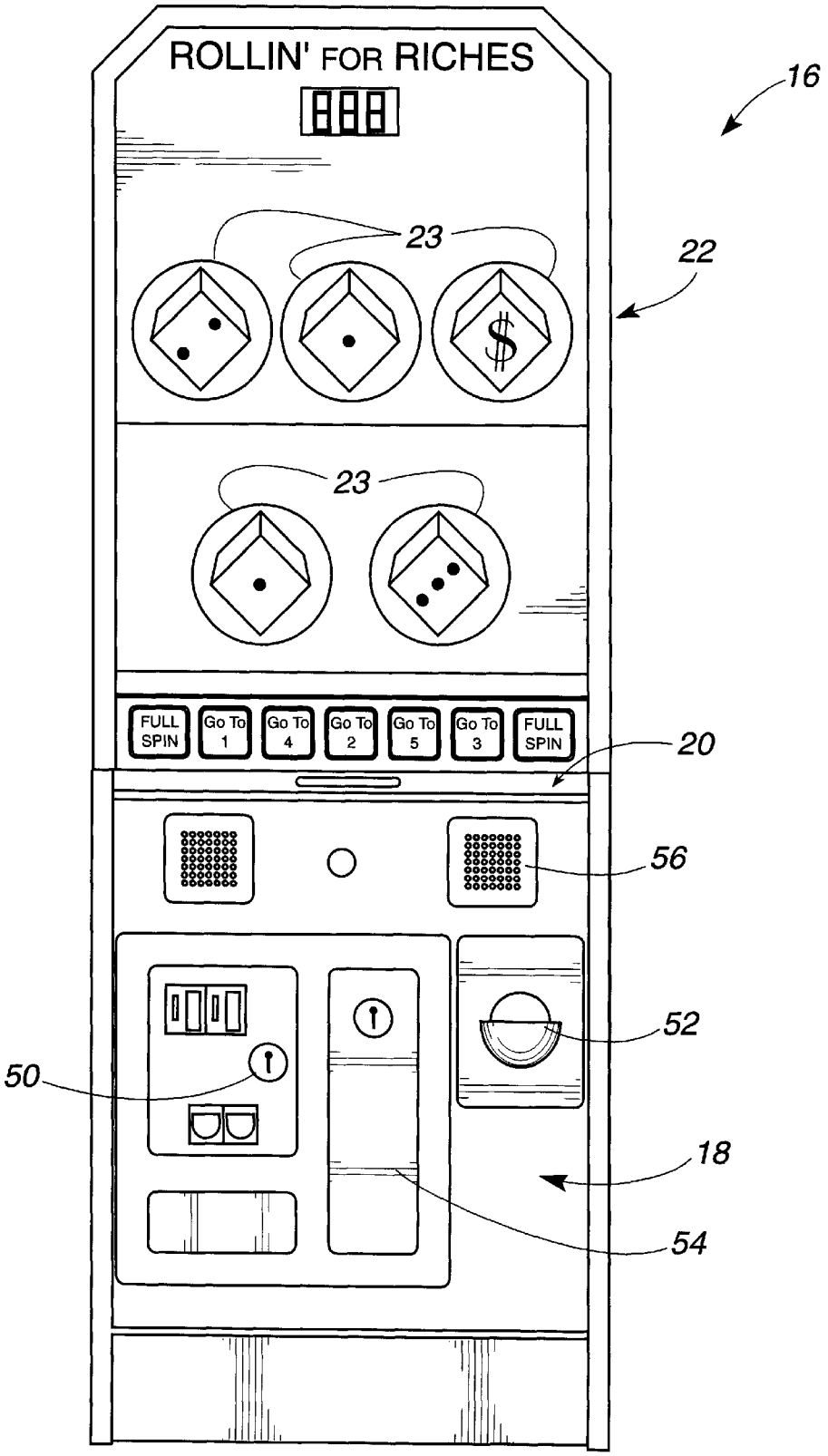
FIG. 4 is a front view of an individual game unit.

FIG. 4 is a front view of the preferred embodiment of an individual game unit 16. The game unit 16 comprises the front panel section 18, a playing surface 20, and the display section 22.

The front panel section 18 comprises a coin box 50, a ball dispenser 52, a ticket dispenser 54, and a speaker 56. The coin box 50 includes a coin deposit slot which accepts standard currency coins or game tokens that are normally available in an arcade environment, and also includes a coin return button and coin return slot. Coin boxes suitable for use in game unit 16 are readily available on the commercial market.

The ball dispenser 52 provides a ball for the player's use. In the preferred embodiment, the balls are rolled by the player down an inclined playing surface 20. Other types of playing pieces can also be used and directed down the playing surface, such as discs, cylinders, or other objects.

Figure 5:
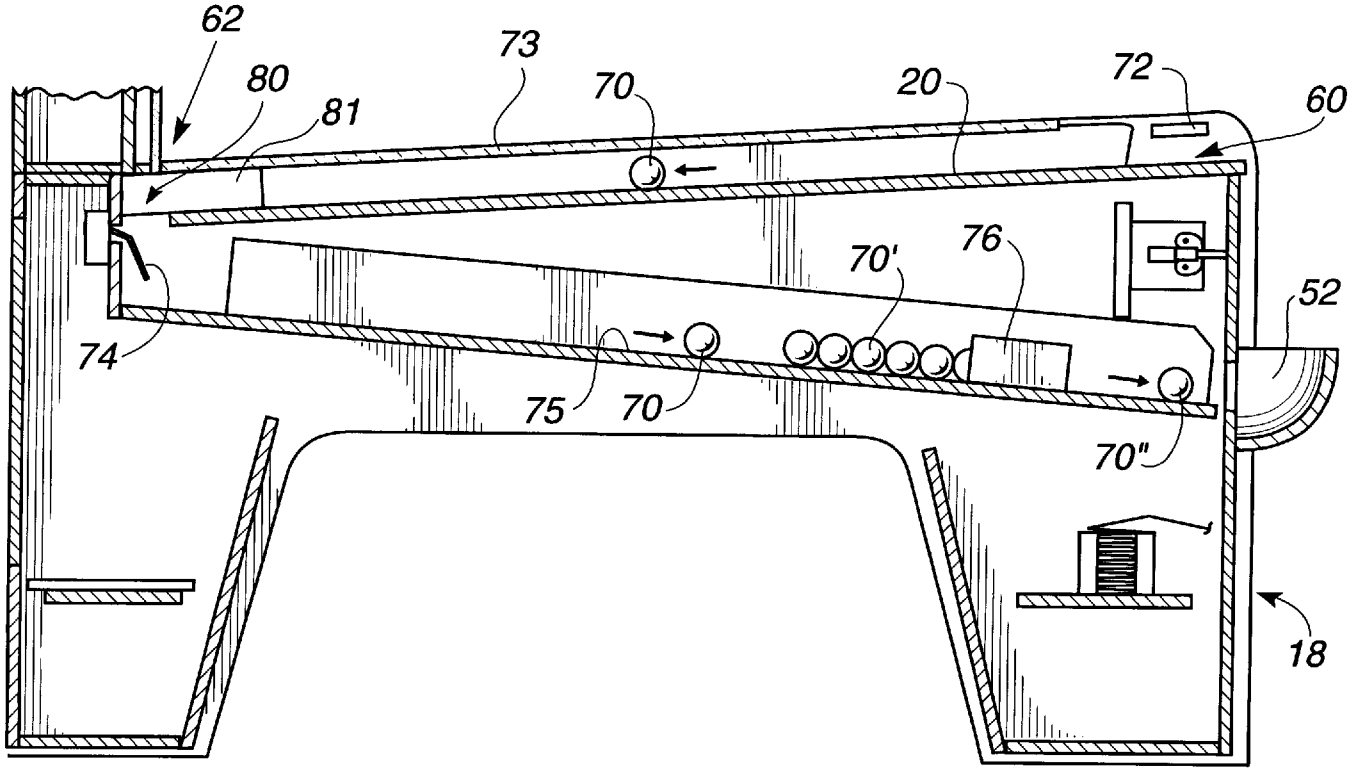
FIG. 5 is a side cross-section of the playing surface and playing piece return mechanism of an individual game unit.

The balls are dispensed to the player as shown in FIG. 5. A ball 70 is picked up by a player from the playing piece dispenser 52 and rolled down the playing surface 20 and through an opening 72 in a transparent top 73 of the game unit 16 which is over the playing surface 20. The ball 70 then rolls down a ramp 75 to join other balls 70' which are held in a holding area 76. A solenoid within the holding area 76 ejects a ball 70" to roll into the playing piece dispenser 52, to be used by the player in the same way as the previous ball 70.

Referring again to FIG. 4, the ticket dispenser 54 dispenses a ticket award to the player based on the game score when the game is completed. Other awards such as sports cards could also be dispensed. The non-monetary award is stored in a storage area behind the front panel 18.

The speaker 56 emits sounds based on game actions and other game states and is controlled by a control system for the game unit. The operation of the speaker will be discussed in greater detail below with respect to FIG. 8.

Figure 6:
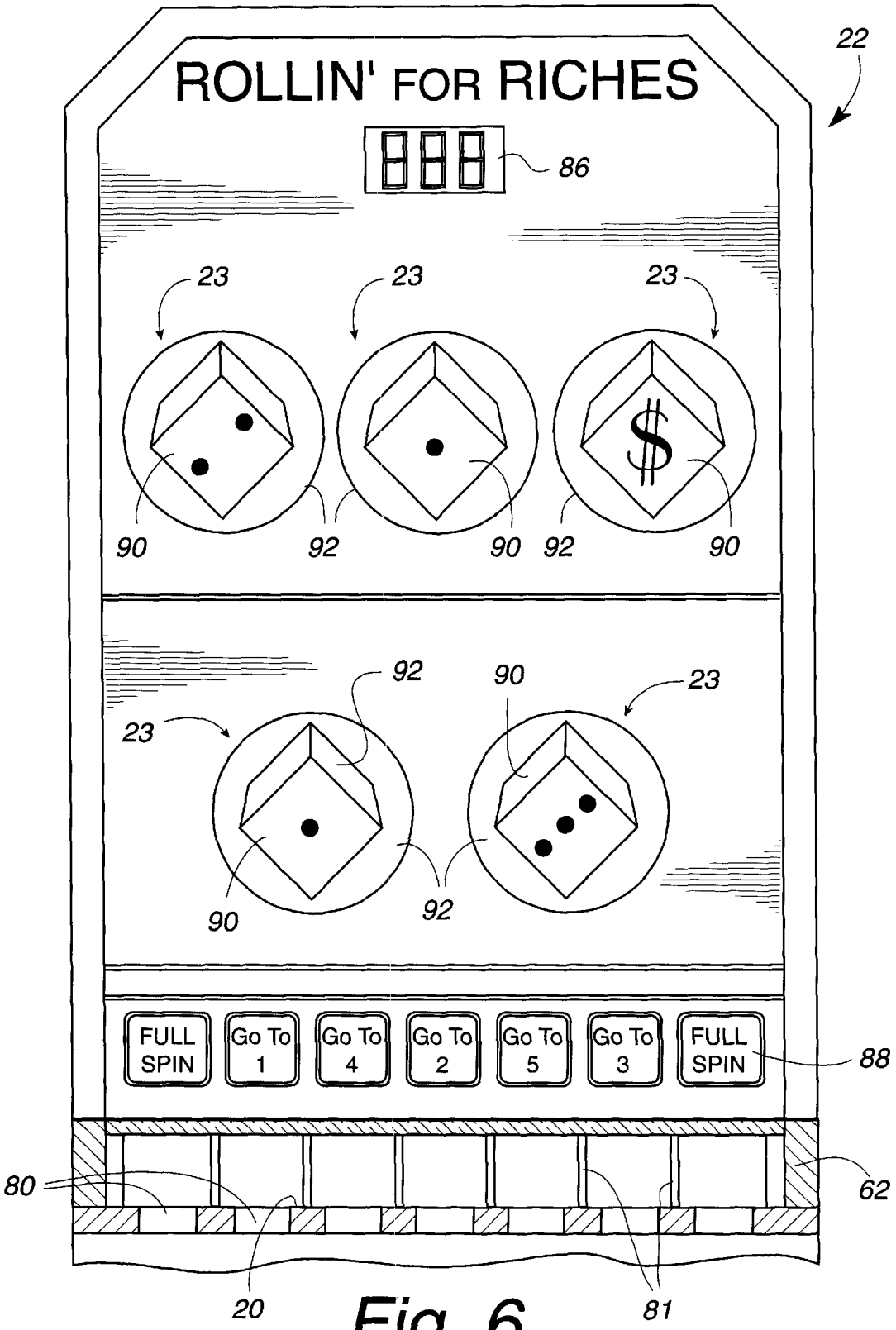
FIG. 6 is a detail view of the dice, display, and target apertures of an individual game unit.

The playing surface 20 is shown in FIGS. 1, 5 and 6. The playing surface 20 includes a player end 60 and a target end 62. Preferably, the surface 20 comprises a ramp where the target end 62 is lower than the player end 60. The player end 60 may include an opening 72 in the transparent top 73 through which the player can release the playing piece 70 onto the playing surface 20. The playing surface 20 is preferably a smooth, unobstructed surface; but it can also be provided with obstacles. The target end 62 includes a plurality of targets 80 that are receptive to the playing piece. In the preferred embodiment, the targets 80 are apertures, holes or slots that are associated with switches 74 such that when the playing piece 70 (e.g., ball) falls through a slot 80, the associated switch 74 is activated. Each slot 80 is defined by slot guide walls 81, which guide the ball into a particular target slot 80 which in turn activates a switch 74. The guide walls 81 extend a short distance from the target end 62 onto the playing surface 20. Lights (not shown) may be provided on the playing surface 20 near each of the slots 80, and the one or more lights corresponding to the slot 80 which receives the playing piece 70 can be illuminated to add excitement to the game.

The display section 22 is shown in greater detail in FIG. 6. The display section 22 includes the multiple score indicators 23, a game score display 86, and target displays 88. FIG. 6 also shows the target end 62 of the playing surface 20 as well as the targets 80.

The multiple score indicators 23 are preferably dice 90. The dice 90 are also preferably rotatably mounted in cups 92. The six sides of each die 90 respectively contain the values of: 1, 2, 3, 4, 5, and $, where $ indicates a wildcard (e.g., a joker in a poker-based game design). Alternatively, the sides of the dice 90 could contain any other values or patterns so long as the value or pattern on each side is different. As shown in FIG. 6, the values are represented by dots, for example, for the value 3, three dots are placed on a side of a die 90. The die 90 is capable of being rotated in two directions under the control of a score indicator driving mechanism 94 (see FIG. 9). The side of the die 90 displayed towards the player is a displayed side. In FIG. 6, the displayed sides of the dice 90 are: 2, 1, $, 1, 3. The combination of the final values of the dice 90 determine the player's score. In this embodiment, the combinations follow those of a poker game. For the displayed sides of the dice 90, the poker-based combination would by Three of a Kind (two "1"s and a wildcard).

The game score display 86 is an LED display that indicates current game score to the player. Target displays 88 indicate the value or function of each individual target slot 80 to the player when a ball 70 is received by that target slot 80. Each die 90 used by the game unit 16 is potentially manipulated by a different ball so that one die is active for each ball. However, in the described embodiment, the player can choose not to manipulate certain of the dice 90, in which case fewer balls are played by the player because fewer balls are provided to the player. In this illustrated embodiment the function of the seven target slots 80 shown in FIG. 6 are: Full Spin, GoTo 1, GoTo 4, GoTo 2, GoTo 5, GoTo 3, Full Spin. With Full Spin, the active die 90 is rotated or spun a random amount. With the GoTo functions, the active dice 90 is rotated or spun to the indicated number. For example, if the active die 90 is at 2, and the target slot 80 corresponding to GoTo 5 is selected, the active die 90 rotates such that when it stops it is at 5.

Figure 7:
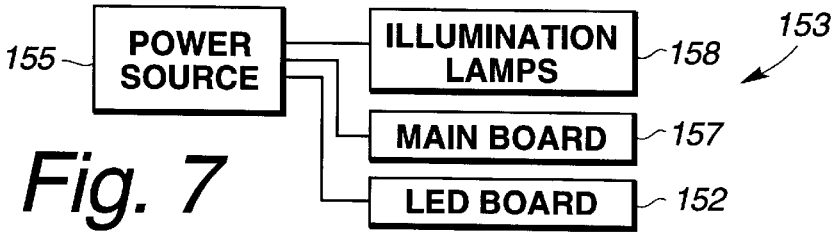
FIG. 7 is a block diagram of the control system for an individual game unit.

FIG. 7 is a block diagram illustrating an electrical system of the game unit 16. The system includes a power source 155, an LED printed circuit board (PCB) 152, a main PCB 157, and illumination lamps 158. The power source 155, in the preferred embodiment, is a commercially available 110 V AC power supply. The LED PCB 152 contains the main game score display 86. The main PCB 157 contains the major circuit components of the game unit 16, including the microprocessor, drivers/buffers, amplifiers, and DIP switches (described in FIG. 8). Finally, the illumination lamps 158 illuminate indicators and other parts of the game unit.

Figure 8:
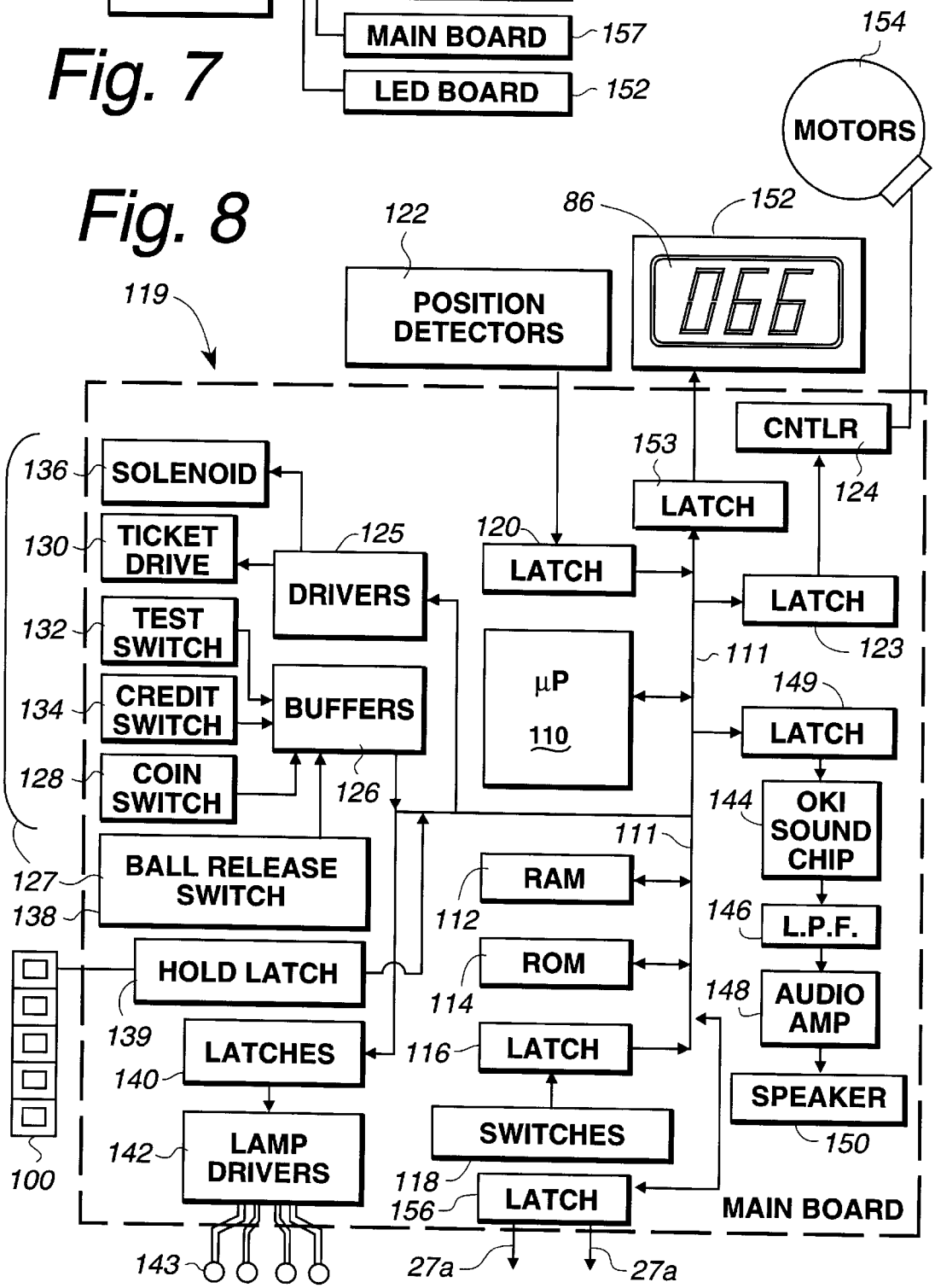
FIG. 8 is a block diagram of the electronic components used in an individual game unit.

FIG. 8 is a block diagram of a control system 119 on the main board 157. The components include a microprocessor 110, RAM 112, ROM 114, a latch 116, DIP switches 118, latch 120, drivers 125, buffers 126, control switches 127, latches 140, lamp drivers 142, sound chip 144, low pass filter 146, audio amplifier 148, and speaker 150. The control system 119 is coupled to position detection mechanism 122, lamps 143, LED PCB 152, and motors 154.

The microprocessor 110 may be an Intel 8031 8-bit microprocessor, which has the range of features adequate for the task, including eight data lines and sixteen address lines. The microprocessor 110 is coupled to ROM 114 by a data/address/control bus 111. The ROM 114 is preferably an erasable, programmable read-only memory (EPROM) that contains the start-up instructions and operating system for the microprocessor 110. Microprocessor 110 is connected to RAM 112 by bus 111 to permit the use of RAM 112 for scratch-pad memory. Methods for coupling ROM 114 and RAM 112 to the microprocessor 110 by bus 111 including enable, address, and control lines are well-known to those skilled in the art.

The microprocessor 110 is also coupled to a latch 116 and switches 118 by the bus 111. The switches 118 provide selectable functions that the owner of the game unit may change to his or her liking. These selectable functions include the values of the targets in terms of score, sound effects, progressive jackpot value (if present), the amount of any award given, the test mode, the type of game, and so on. Other selectable functions could also be set by the switches 118 depending on how many selectable game options and features are desired. The switches 118 also include, in the present embodiment, the switches 74 that are activated when a playing piece 70 rolls into a target slot 80 on the playing surface 20.

The microprocessor 110 is also coupled to another latch 120, which is similar to the latch 116 that connects the switches 118 to the microprocessor 110. The latch 120 receives data indicating the position (or at least a calibration position) of each of the dice 90 from the position detectors 122. The latch 120 is coupled to the microprocessor 110. Preferably, the microprocessor 110 polls the latch 120 to obtain the current position of each of the dice 90. The position detectors 122 are discussed in greater detail below in FIG. 9.

The microprocessor 110 is also coupled to the drivers 125 and the buffers 126. The buffers 126 receive data from many of the switches 127, including the coin switch 128, which detects if a coin has been inserted into the game unit 16; the test switch 132, which activates a test mode for the game unit 16; the credit switch 134, which, when pushed by a player, starts a game; the ball release switch 138, which indicates to the microprocessor 110 if a playing piece 70 has actually been dispensed to the player; and a hold latch 139, which receives data from the hold buttons 100 indicating how many balls the player wants to play. The drivers 125 activate the remaining switches 127, including the ticket drive 130, which activates the dispensing of the non-monetary award (in this case, tickets) out of the non-monetary award dispenser 54; and the solenoid 136, which pushes a ball 70 into the ball dispenser 52.

The control system 119 controls the overall operation of the game. The game processing is described with reference to FIG. 10 below. In order to cause the dice 90 to rotate or spin, the control system 119 includes a latch 123 coupled to the microprocessor 110 via the bus 111, and a motor controller 124. The motor controller 124 supplies driving signals to motors 154, namely each of five motors 154 are individually driven by the controller 124 which in turn is controlled by the microprocessor 110. The motors 154 are preferably stepper motors and are well-known to those skilled in the art. Each motor 154 is controlled by the motor controller 124 to rotate or spin one of the dice 90.

The microprocessor 110 is also coupled to the latches 140 which latch data for the lamp drivers 142. The lamp drivers 142 supply power to the lamps 143, which include the lights on the display section 22 of the game unit 16 that are not part of the game score display 86 or other numeric displays.

The microprocessor 110 is also coupled to a sound chip 148. This chip is an OKI Voice Synthesis LSI chip that has eight data input lines coupled to the microprocessor 110 by a latch 149. The sound chip 144 receives its data from ROMs (not shown) and outputs sound data to a low pass filter 146, an audio power amplifier 148, and finally to the output speaker 150, which generates sounds to the player playing the game unit 16.

The microprocessor 110 is also coupled to a separate printed circuit board 152 containing the game score display. The bus 111 connecting the microprocessor to the display board 152 are latched by a latch 153.

Further, the latch 156 couples the progressive bonus apparatus 12 (if provided) to the control system 119. In particular, the buses 27*a* and 27*b* of the progressive bonus apparatus 12 are coupled to the latch 156 and the latch 156 is in turn coupled to the microprocessor 110 via the bus 111.

The control system 119 operates briefly as follows. The microprocessor 110 first reads the low memory from ROM 114 over bus 111 and sequences through the software instructions stored in ROM 114. The settings of DIP switches in the switches block 118 are also read into the microprocessor 110. The software from the ROM 114 then instructs the microprocessor 110 to send and receive data over the bus 111 in order to conduct a game. For example, when the coin switch 128 is activated, indicating a coin has been inserted into the game unit, the microprocessor 110 reads a signal from the buffers 126 from bus 111. The microprocessor 110 in conjunction with the other hardware then implements the game processing described with reference to FIG. 10 below. Nevertheless, some basic operations controlled by the control system 119 are now briefly explained. The microprocessor 110 then sends a signal to the drivers 125 to activate solenoid 136 in order to dispense a ball 70 to the player. The ball release switch 127 sends a signal through the buffers 126 to the microprocessor 110, indicating that a ball has been dispensed. The microprocessor 110 then awaits a signal from switches 118 that indicate which switch 74 in target slot 80 the ball 70 activated. The specific switch 118 signal determines the data the microprocessor 110 will send to the one of the motors 154 in order to rotate the appropriate die 90 a specific amount (see discussion below with respect to FIG. 9 for a detailed description of the motors and die rotation). The microprocessor 110 also reads a calibration position from latch 120 when available or needed. The microprocessor 110 can modify the game score by a specific amount and update the game score display 86 with the new score by sending a signal to LED PCB 152. The microprocessor 110 in conjunction with the hold buttons 100 determines how many balls are to be played. The microprocessor 110 then dispenses another ball 70 and repeats the game process until all balls to be played have been dispensed. During game play, the microprocessor 110 sends appropriate output signals over bus 111 to activate speaker 150 and lamps 143 whenever game action occurs.

Figure 9:
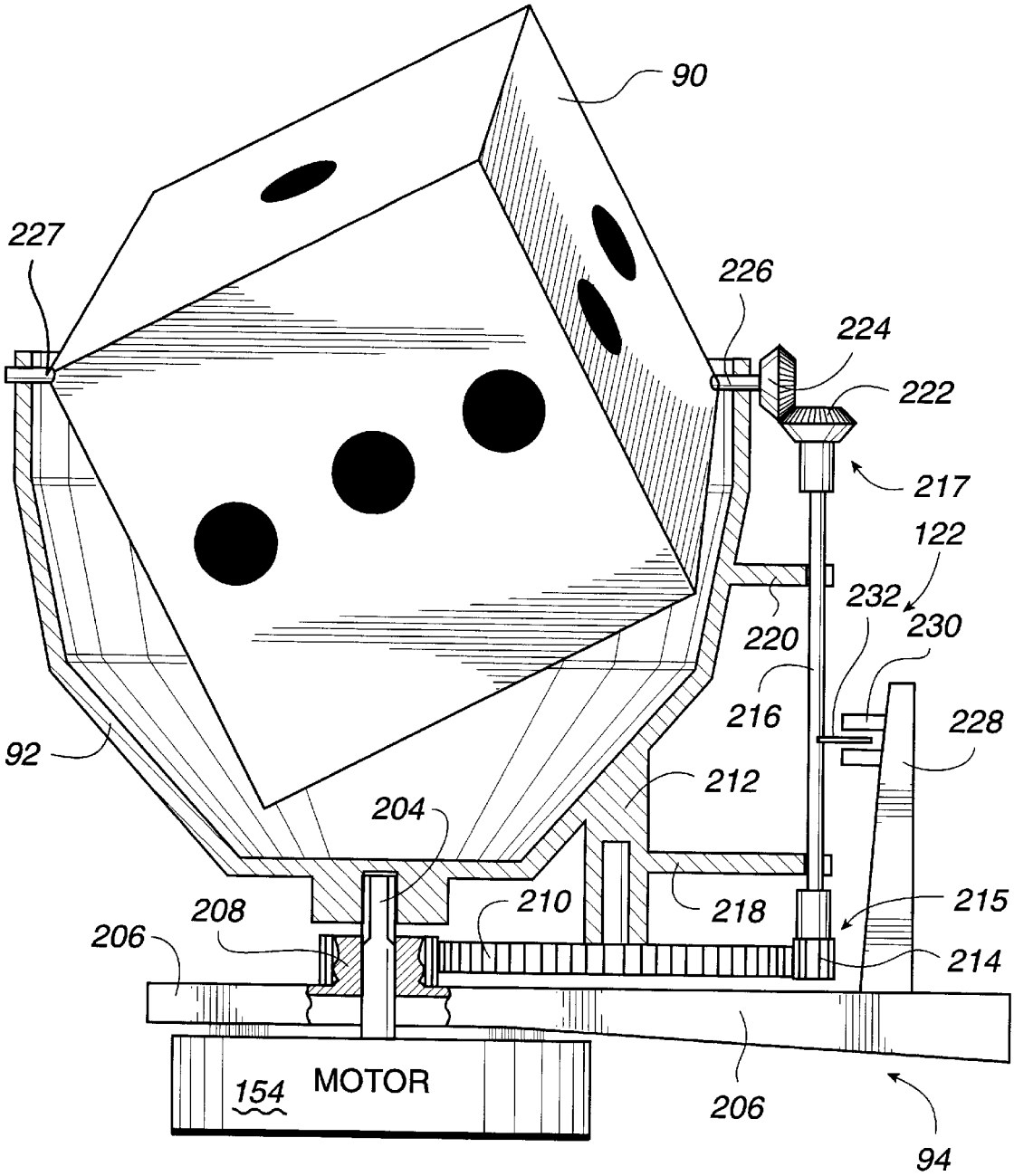
FIG. 9 is a cross section view of a score indicator driving mechanism of an individual game unit and a perspective view of a die therewith.

FIG. 9 is a cross-sectional diagram illustrating an embodiment of the score indicator driving mechanism 94. Mechanism 94 is located on the backside 166 of the display section 22. In this embodiment, each of the score indicators 23 is driven by one of the mechanisms 94 shown in FIG. 9.

The score indicator driving mechanism 94 rotates a die 90 by one of the motors 154 controlled by a motor controller 124 of the control system 119. The motor 154 operates to spin a spindle 204 which is affixed to the cup 92. The motor 154 is attached to a support housing 206 and the spindle 204 passes through an opening in the support housing 206. Hence, when the motor 154 causes the spindle 204 to turn, the cup 92 also turns. A first gear 208 is affixed to the support housing 206 and interacts with a second gear 210 which is affixed to the cup 92 via a support 212. As the cup 92 is rotated by the motor 154, the second gear 210 rotates about the first gear 208, but the second gear 210 does not rotate about the support 212. A third gear 214 interacts with the second gear 210 at a first end 215 of a spindle 216 to cause the spindle 216 to rotate as the spindle 204 rotates. The spindle 216 is supported by the cup 92 through supports 218 and 220. The opposite end 217 of the spindle 216 contains a fourth gear 222 which rotates as the spindle 216 rotates. The fourth gear 222 interacts with a fifth gear 224. The fifth gear 224 is affixed to a pin 226 which passes through a hole in the lip portion of the cup 92 and is also affixed to a corner of the particular die 90 being manipulated by this mechanism 94. A pin 227 is rotatably coupled to the lip portion of an opposite side of the cup 92 and the comer of the die 90 farthest from the corner coupled to the pin 226.

The various gears used in the score indicator driving mechanism 94 are such that the die 90 rotates as the cup 92 spins. The direction of rotation of the cup 92 is, however, perpendicular to the direction of rotation of the die 90. The relationship of the gears 208, 210, 214, 222, and 224 as well as the motor 154 is such that every pulse sent to the motor 154 by the controller 124 from the control system 119 causes the cup 92 to rotate 7.5° counter clockwise. Hence, there are 48 steps per revolution of the cup, but three revolutions of the cup are needed to return to the number initially started with. For example, if the die 90 is initially at a value of "1", then to obtain the other values for the die 90, the number of pulses needed to advance to the next number are given in Table 1 below.

TABLE 1

| Next number | Pulses needed |
|---|---|
| 1 | 0 |
| 2 | 24 |
| 4 | 48 |
| 6 | 72 |
| 5 | 96 |
| 3 | 120 |

The score indicator driving mechanism 94 further includes a support 228 which is integral with the support housing 206. The support 228 supports a beam detector 230. The beam detector 230 serves as the position detector 122 for the die 90 and provides calibration data to the microprocessor 110 via the latch 120. A reference panel 232 affixed to the spindle 216 rotates about the spindle 216 as the spindle 216 rotates. The rotation of the spindle 216 is related in a fixed way to the position of the die 90. Preferably, when the reference panel 232 interrupts the a beam provided by the beam detector 230, the beam detector 230 notifies the microprocessor 110 that the die 90 (or cup 92) are at the calibration point. The calibration point may, for example, by the point at which the displayed side of the die 90 is at a value of "1". Here, the position detector 122 is implemented by the beam detector 230 and the reference panel 232. However, many other approaches to obtaining similar calibration data or even complete position data are understood by those skilled in the art. For example, rotation any of any of the spindles could by monitored by an encoder; or a mechanical switch could be used to sense a calibration point.

The dice apparatus shown in FIG. 9 is commercially available (i.e., Starpoint IDU Modular Dice Mechanism) from Starpoint Electrics Limited of Morden, Surry in the United Kingdom.

Figure 10:
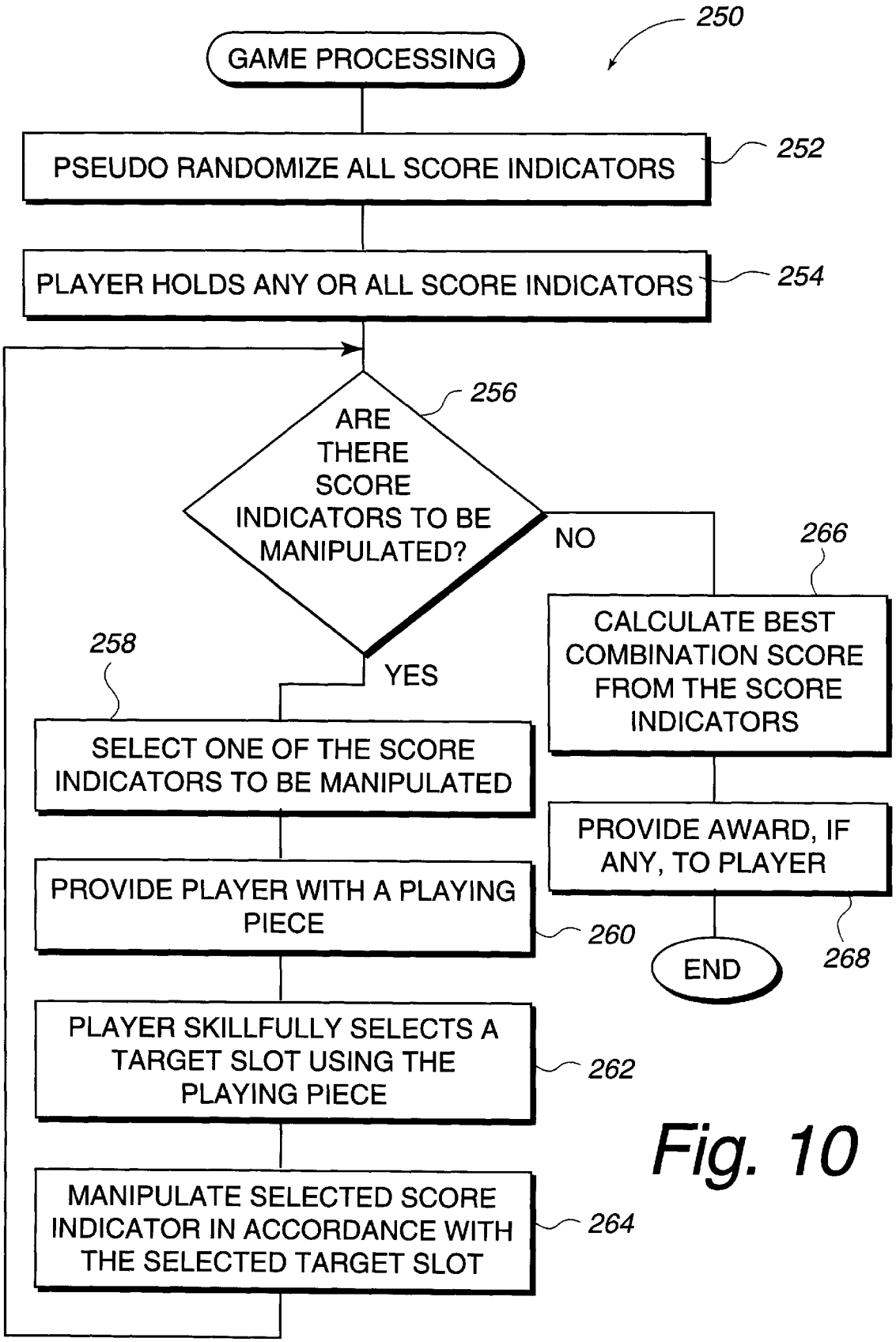
FIG. 10 is a flow chart of game processing of the invention.

FIG. 10 is flowchart of the game processing 250 in accordance with the invention. The game processing 250 is primarily carried out by the microprocessor 110 of the control system 119.

The game processing 250 begins once a player has inserted coins into the coin box 50. Initially, the game processing 250 pseudo randomizes 252 all of the score indicators 23. Namely, it is preferred that the game begin with all of the score indicators 23 pointing to or displaying a one value, and then once the game is initiated the score indicators 23 in effect randomize their values. In the preferred operation of the game, the score indicators are used in a poker type of game; hence, the randomization 252 corresponds to dealing cards to a poker player. The microprocessor 110 keeps track of the position of each die 90.

Next, the player is able to hold 254 any or all of the score indicators 23. The player is able to make such selections using hold buttons 100 at the player end 60 of the game 16. Preferably, there is a separate hold button for each of the score indicators 23. By using the hold buttons 100, the player can individually hold (i.e., prevent spinning) the value of the associated score indicator 23 by pressing the appropriate hold button 100 for that die 90.

Next, a decision 256 based on whether there are score indicators 23 to be manipulated by the game. Each of the score indicators 23 of the game are to be manipulated by the player's use of a playing piece, unless the score indicator 23 has been held by the player via the hold buttons 100. Hence, when there are score indicators 23 to be manipulated, one of the score indicators 23 to be manipulated is selected 258 for manipulation. Then, the player is provided 260 with a playing piece (e.g., a ball). Next, the player attempts to select 262 a particular one of the target slots 80 using the playing piece in accordance with the player's skilled action. Preferably, as discussed above, the playing action is the release or movement of the playing piece at the player end 60 in a manner such that the playing piece will enter the desired target slot 80 at the target end of the playing surface 20. Thereafter, the associated score indicator is manipulated 264 by the control system 119 in accordance with the target slot 80 which was selected by the playing piece. The activated switch 74 associated with the selected target slot 80 sends a signal to the microprocessor 110 which determines the die 90 and the data to send to the motor controller 124. The motor 154 then turns the appropriate die 90, thereby rotating the die 90 an appropriate amount based on the slot 80 which received the ball 70. Preferably, the manipulation 264 of the score indicator 23 rotates the associated die 90 in either a random spin or to a value indicated be the selected target slot 80. As shown in FIG. 6, each of the target slots 80 has a target display 88 that indicates how the score indicator 23 will be manipulated when that particular target slot 80 is selected by the playing piece. One of the target slot 80 designations might be "Full spin". This would mean that a fast spin with a random result would be imparted on the appropriate die 90 by the motor 154. The microprocessor 110 keeps track of the position or values of each of the dice 90 using the calibration position using the position detectors 122 and counting steps sent to each of the stepper motor 154. Following block 264, the game processing 250 returns to repeat the decision block 256 in case there are additional score indicators 23 still to be manipulated.

When there are no more score indicators 23 to be manipulated, the decision block 256 causes the player's score to be calculated 266 from the score indicators 23. Here, the calculation 266 of the player's score is preferably done in a poker type fashion in which the player's score varies based on various combinations of the score indicators 23. For example, in the case in which non-monetary awards are provided to the player, the pay out could be in accordance with Table 2 as follows.

TABLE 2

| Winning Combination | Number of Tickets |
|---|---|
| 1 pair | 3 tickets |
| 2 pairs | 5 tickets |
| 3 of a kind (with Jokers) | 7 tickets |
| 3 of a kind (no Jokers) | 9 tickets |
| Straight (with Jokers) | 10 tickets |
| Straight (without Jokers) | 12 tickets |
| Full House (with Jokers) | 14 tickets |
| Full House (without Jokers) | 16 tickets |
| Four of a Kind (with Jokers) | 16 tickets |
| Four of a Kind (without Jokers) | 18 tickets |
| Five of a Kind (with Jokers) | 20 tickets |
| Five of a Kind (without Jokers) | 30 tickets |
| Royal Straight | 50 tickets |

The award is then provided 268 to the player and the game is completed. Note that the player is also eligible to receive a progressive award if the progressive apparatus 12 is coupled to the game 16 being played by the player. As an example, the progressive jackpot could be won by the player if the player achieves a Royal Straight in two consecutive games. Of course, the award amounts and conditions for winning a progressive bonus can vary greatly depending upon the game owner's desires.

Figure 11:
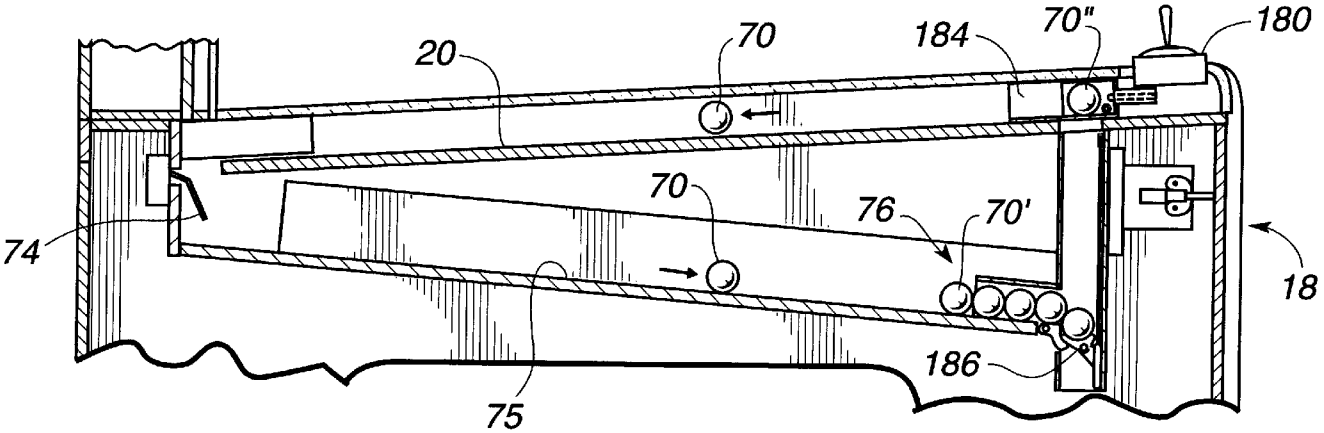
FIG. 11 is a cross-sectional view of the playing surface and playing piece return mechanism of an alternate embodiment of the invention.

An alternate embodiment of the game unit is detailed in FIG. 11 in which there is no player contact with the ball 70. In this embodiment, the ball 70 is directed down the playing surface 20, its path being determined by controller 260, which might be a joystick controller as found on other arcade-type games. The controller 70 directs a guiding mechanism 264 left and right so that the player can decide to release the ball 70 when the guiding mechanism 264 is in position to release the ball 70 at a desired target. The ball 70 is directed down to the target end 62 and activates a switch 74 behind a specific target slot 80. The ball 70 then moves down ramp 75 to the holding area 76 where the other balls 70' are held, as in the previous embodiment. Meanwhile, switch 74 activates a rotating wheel and a score is determined; wheel mechanics and game score are achieved in a similar fashion to the embodiment described previously.

Figure 13:
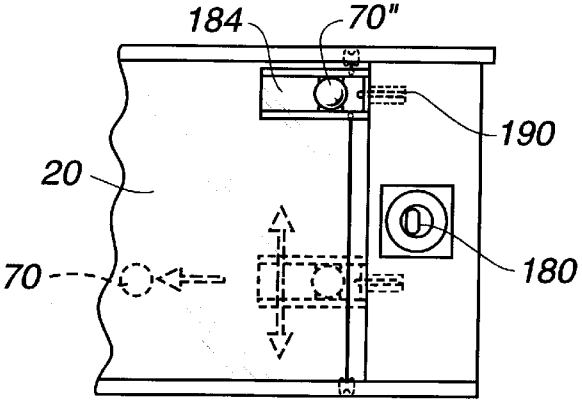
FIG. 13 is a partial top view of the playing surface of the alternate embodiment of FIG. 11.
Figure 12:
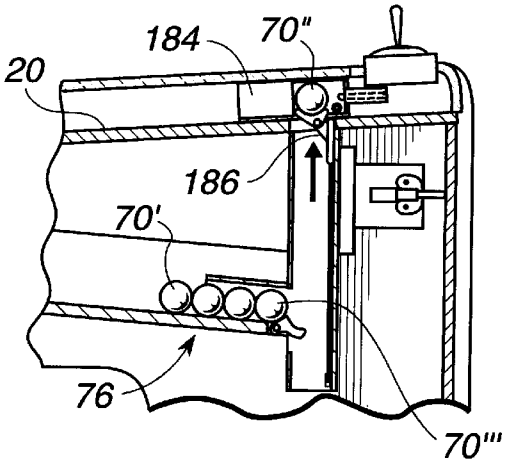
FIG. 12 is a detail view of the ball return mechanism of FIG. 11.

FIG. 12 illustrates the dispensing of a ball 70" to the guiding mechanism 264 in the alternate embodiment of FIG. 13. The ball 70" waits in holding area 76 on an elevator platform 266. When a previous ball 70 returns to holding area 76 and hits ball 70', elevator platform 266 moves upward by electrical motors, carrying ball 70". Elevator platform 266 stops moving when it is level with playing surface 20 and ball 70" is pushed through an opening in guiding mechanism 264 so that it rests in guiding mechanism 264. A player may now move and control the guiding mechanism 264 containing ball 70" using controller 260. Meanwhile, the elevator platform 266 moves down again to holding area 76 and the next ball 70'" moves onto it.

FIG. 13 further illustrates the guiding mechanism 264. The guiding mechanism 264 is moved left and right as determined by controller 260. Controller 260 can control the guiding mechanism 264 by electrical signals and motors, or a mechanical system of gears, pulleys, etc. The guiding mechanism can also be controlled without a controller 260; for example, a player can move the guiding mechanism 264 manually by using a handle 190 attached to the guiding mechanism 264. The ball 70 is released from guiding mechanism 264 by activating a release control on the controller 260 when the guiding mechanism 264 is in the desired position. A solenoid or other electrical pushing mechanism can be used to eject the ball from the guiding mechanism, or an alternate method might be to use a mechanical release tab or spring to eject the ball 70 down the playing surface 20.

The invention may alternatively be embodied in a game unit in which a video screen is used to display graphic images of the mechanisms discussed above that are associated with the display section 22. Namely, the score indicators 23 and the game score display 86. Additional details on such an embodiment are contained in U.S. Pat. No. 5,409,225, which has been incorporated by reference.

While this invention has been described in terms of several preferred embodiments, it is contemplated that alterations, modifications and permutations thereof will become apparent to those skilled in the art upon a reading of the specification and study of the drawings. For example, the playing surface 20 of the game unit 16 can be situated horizontally. The multiple score indicators 23 can be other than dice 90. For example, the multiple score indicators could be spinning wheels such as disclosed in U.S. Pat. Nos. 5,409,225 and 5,292,127 which have been incorporated by reference, though the spinning wheels therein disclosed would preferably be reduced in size to better fit the display area 22. The playing surface 20 can also be angled such that the target end 62 is higher than the player end 60.

It is therefore intended that the following claims include all such alterations, modifications and permutations as fall within the spirit and scope of the present invention.

What is claimed is:

1. A skill game, comprising:

at least one playing piece;

a game cabinet having a players end and a target end, said game cabinet including at least a playing surface between the players end and the target end of said game cabinet, a player causes the playing piece to traverse said playing surface towards the target end;

a plurality of targets in said playing surface or at the target end for receiving the playing piece, each of the targets indicating a different scoring action; and a plurality of score indicators, each of said score indicators being individually controlled in accordance with the particular one of the targets that receives the playing piece, and each of said score indicators being a die which is rotatable, wherein the player's score is determined by one of or a combination of said plurality of score indicators.

2. A skill game as recited in claim 2, wherein the playing piece is a ball and said playing surface is a downwardly sloping planar surface.

3. A skill game as recited in claim 1, wherein said skill game further comprises:

a score controller determining the player's score based on said plurality of score indicators.

4. A skill game as recited in claim 3, wherein said score controller determines the player's score as the combination of said plurality of score indicators yielding the greatest score.

5. A skill game as recited in claim 3, wherein said skill game further comprises:

an award dispenser for dispensing an award based on the player's score determined by said score controller.

6. A skill game as recited in claim 1, wherein said skill game is one of a plurality of game units coupled to a progressive bonus apparatus, said progressive bonus apparatus accumulates a progressive bonus based on contributions from the plurality of game units, and provides a bonus award based upon the progressive bonus to a player of one of the game units when said player accomplishes a predetermined task.

7. A skilled game as recited in claim 1, wherein the targets are slotted targets.

8. An apparatus associated with a game of skill, said apparatus comprising:

multiple score indicators;

means for rolling a playing piece down a playing surface towards targets associated with the playing surface, and means for allowing the user to use the targets to manipulate said multiple score indicators so as to use one's skill to obtain a winning combination of the scores indicated by said multiple score indicators.

9. An apparatus recited in claim 8, wherein the targets are slotted targets.

10. A method associated with a game of skill, the game using a cabinet having a players end and a target end and a playing surface there between, the target end or the playing surface includes a plurality of targets for receiving the playing piece, the cabinet further having multiple score indicators, said method comprising:

(a) causing a playing piece to traverse the playing surface from the players end towards the target end;

(b) receiving the playing piece at one of the targets;

(c) causing one or more of the multiple score indicators to change based on the one of the targets that has received the playing piece, each of the score indicators being a rotatable cube; and (d) determining a score by one of or a combination of the multiple of score indicators.

11. A method as recited in claim 10, wherein said causing (a) is carried out by a player's action.

12. A method as recited in claim 10, wherein the playing piece is a ball which traverses the playing surface by rolling on the playing surface towards the target end.

13. A method as recited in claim 12 wherein the targets are target slots that receive the ball, and wherein a player releases the ball at the player's end and directs it towards one of the target slots.

14. A method as recited in claim 12, wherein the player receives one ball for each of the multiple score indicators.

15. A method as recited in claim 10, wherein each of said rotatable cubes is a die which is rotatable, and wherein the playing piece is a ball and said playing surface is a downwardly sloping planar surface.

16. A method as recited in claim 10, wherein the extent to which the one or more score indicators change depends upon one of the targets that has received the playing piece.

17. A method as recited in claim 10, wherein said method further comprises (e) presetting the multiple score indicators prior to said causing (a), and wherein said causing (c) comprises:

(c1) determining which of the multiple score indicators change; and (c2) for each of the multiple score indicators to be changed, sequentially cause a playing place to traverse the playing surface towards the target end.

18. A method as recited in claim 10, wherein said method further comprises: (e) dispensing a physical award to a player.

19. A method as recited in claim 10, wherein said method further comprises:

(e) determining if the score obtained by a player qualifies for a bonus award; and (f) dispensing a physical award to the player, the value of the physical award being based upon the bonus award if the player is determined to qualify for the bonus award, or the score of the player when the player does not qualify for the bonus award.

20. A method associated with a game of skill using multiple score indicators, said method comprising:

(a) randomizing all the score indicators;

(b) allowing a player to lock any or all of the score indicators;

(c) designate one of the unlocked score indicators to be manipulated;

(d) allowing the player to use a skilled action to select one of a plurality of targets;

(e) manipulating the designated score indicator in accordance with the selected target;

(f) repeating (c)–(e) as long as there are additional score indicators to be manipulated;

(g) determining the player's score by a combination of the score indicators.

21. A method as recited in claim 20, wherein the score indicators are dice which are rotatable.

22. A method as recited in claim 20, wherein the game uses a cabinet having a players end and a target end and a playing surface there between, wherein the targets are target slots at the target end or in the playing surface; and wherein the skilled action of the player directs a playing piece towards the target slots.

23. A method as recited in claim 22, wherein the score indicators are dice which are rotatable, and the playing piece is a ball.

24. A method as recited in claim 23, wherein the playing surface is a downwardly sloping planar surface.

25. A method as recited in claim 20, wherein said method further comprises (h) providing an award to the player in dependence upon the score.

26. A method as recited in claim 20, wherein said (g) determining calculates the combination of the score indicators that provides the greatest award, and wherein said method further comprises (h) providing an award to the player in dependence upon the score.

27. A method as recited in claim 20, wherein said manipulating (e) comprises:

(e1) manipulating the designated score indicator a first predetermined amount when the selected target is a first target;

(e2) manipulating the designated score indicator a second predetermined amount when the selected target is a second target, and (e3) manipulating the designated score indicator randomly when the selected target is a third target.

28. A method as recited in claim 27, wherein said manipulating (e) further comprises (e4) manipulating any one or more of the score indicators randomly when the selected target is a fourth target.

29. A skill game, comprising:

at least one playing piece;

a game cabinet having a players end and a target end, said game cabinet including at least a playing surface between the players end and the target end of said game cabinet, a player causes the playing piece to traverse said playing surface towards the target end;

a plurality of targets in said playing surface or at the target end for receiving the playing piece, each of the targets indicating a different scoring action; and a plurality of score indicators, each being a die which is rotatable, each of said score indicators being individually controlled in accordance with the particular one of the targets that receives the playing piece, wherein the player's score is determined by one of or a combination of said plurality of score indicators, and wherein the target that receives the playing piece changes the score indicator associated with the playing piece to a predetermined value or by an incremental amount, the predetermined value or the incremental amount being determined based on the particular one of the targets that receives the playing piece.

30. A skill game as recited in claim 29, wherein the playing piece is a ball and said playing surface is a downwardly sloping planar surface.

* * * * *

UNITED STATES PATENT AND TRADEMARK OFFICE

CERTIFICATE OF CORRECTION

PATENT NO. : 5,803,451
DATED : September 8, 1998
INVENTOR(S) : Kelly et al.

It is certified that error appears in the above-indentified patent and that said Letters Patent is hereby corrected as shown below:

Column 10, line 62, change "comer" to --corner--
Column 11, line 44, change "IDU" to --1DU--

Column 14, line 25, change "claim 2" to --claim 1--

Signed and Sealed this

Twenty-seventh Day of July, 1999

*Attest:*

Q. TODD DICKINSON

*Attesting Officer*

*Acting Commissioner of Patents and Trademarks*